US006522259B1

(12) United States Patent
Tamura

(10) Patent No.: US 6,522,259 B1
(45) Date of Patent: Feb. 18, 2003

(54) OPEN CRIB GATE ALARM SYSTEM

(76) Inventor: Jeffrey K. Tamura, 23441 Golden Springs, #159, Diamond Bar, CA (US) 91765

( * ) Notice: Subject to any disclaimer, the term of this patent is extended or adjusted under 35 U.S.C. 154(b) by 0 days.

(21) Appl. No.: 09/904,718

(22) Filed: Jul. 13, 2001

(51) Int. Cl.[7] ..... G08B 21/00

(52) U.S. Cl. ..... 340/686.1; 340/686.2; 340/691.1; 340/547

(58) Field of Search ..... 340/686.1, 686.2, 340/686.6, 687, 691.1, 545.1, 545.3, 551, 552, 556–564, 693.9, 547

(56) References Cited

U.S. PATENT DOCUMENTS

| | | | | | |
|---|---|---|---|---|---|
| 2,734,104 | A | | 2/1956 | Gollhofer | 200/61.75 |
| 4,231,030 | A | | 10/1980 | Weiss | 340/686.1 |
| 4,951,032 | A | * | 8/1990 | Langsam | 340/686.1 |
| D336,351 | S | | 6/1993 | Freese et al. | D26/60 |
| 5,629,683 | A | | 5/1997 | Slomowitz et al. | 340/686.1 |
| 5,757,274 | A | | 5/1998 | Slomowitz et al. | 340/573.1 |
| 6,114,963 | A | * | 9/2000 | Blake et al. | 340/573.4 |
| 6,225,913 | B1 | * | 5/2001 | Slomowitz et al. | 340/686.1 |

* cited by examiner

*Primary Examiner*—Toan Pham

(57) ABSTRACT

An open crib gate alarm system for providing a visual and audible alarm when the gate to the crib is left in an open position. The open crib gate alarm system includes a crib having a gate which can be lowered and raised; and also includes an alarm assembly including an alarm unit having a housing being securely fastened to the gate, and also including a first switch member being securely attached to the gate, and further including a second switch member being securely attached to the crib for activating the alarm unit.

2 Claims, 2 Drawing Sheets

OPEN CRIB GATE ALARM SYSTEM

BACKGROUND OF THE INVENTION

1. Field of the Invention

The present invention relates to a crib gate warning device and more particularly pertains to a new open crib gate alarm system for providing a visual and audible alarm when the gate to the crib is left in an open position.

2. Description of the Prior Art

The use of a crib gate warning device is known in the prior art. More specifically, a crib gate warning device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,231,030; 5,757,274; 5,629,683; 4,951,032; 2,734,104; and U.S. Pat. No. Des. 336,351.

While these devices fulfill their respective, particular objectives and requirements, the aforementioned patents do not disclose a new open crib gate alarm system. The inventive device includes a crib having a gate which can be lowered and raised; and also includes an alarm assembly including an alarm unit having a housing being securely fastened to the gate, and also including a first switch member being securely attached to the gate, and further including a second switch member being securely attached to the crib for activating the alarm unit.

In these respects, the open crib gate alarm system according to the present invention substantially departs from the conventional concepts and designs of the prior art, and in so doing provides an apparatus primarily developed for the purpose of providing a visual and audible alarm when the gate to the crib is left in an open position.

SUMMARY OF THE INVENTION

In view of the foregoing disadvantages inherent in the known types of crib gate warning device now present in the prior art, the present invention provides a new open crib gate alarm system construction wherein the same can be utilized for providing a visual and audible alarm when the gate to the crib is left in an open position.

The general purpose of the present invention, which will be described subsequently in greater detail, is to provide a new open crib gate alarm system which has many of the advantages of the crib gate warning device mentioned heretofore and many novel features that result in a new open crib gate alarm system which is not anticipated, rendered obvious, suggested, or even implied by any of the prior art crib gate warning device, either alone or in any combination thereof.

To attain this, the present invention generally comprises a crib having a gate which can be lowered and raised; and also includes an alarm assembly including an alarm unit having a housing being securely fastened to the gate, and also including a first switch member being securely attached to the gate, and further including a second switch member being securely attached to the crib for activating the alarm unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new open crib gate alarm system which has many of the advantages of the crib gate warning device mentioned heretofore and many novel features that result in a new open crib gate alarm system which is not anticipated, rendered obvious, suggested, or even implied by any of the prior art crib gate warning device, either alone or in any combination thereof.

It is another object of the present invention to provide a new open crib gate alarm system which may be easily and efficiently manufactured and marketed.

It is a further object of the present invention to provide a new open crib gate alarm system which is of a durable and reliable construction.

An even further object of the present invention is to provide a new open crib gate alarm system which is susceptible of a low cost of manufacture with regard to both materials and labor, and which accordingly is then susceptible of low prices of sale to the consuming public, thereby making such open crib gate alarm system economically available to the buying public.

Still yet another object of the present invention is to provide a new open crib gate alarm system which provides in the apparatuses and methods of the prior art some of the advantages thereof, while simultaneously overcoming some of the disadvantages normally associated therewith.

Still another object of the present invention is to provide a new open crib gate alarm system for providing a visual and audible alarm when the gate to the crib is left in an open position.

Yet another object of the present invention is to provide a new open crib gate alarm system which includes a crib having a gate which can be lowered and raised; and also includes an alarm assembly including an alarm unit having a housing being securely fastened to the gate, and also including a first switch member being securely attached to the gate, and further including a second switch member being securely attached to the crib for activating the alarm unit.

Still yet another object of the present invention is to provide a new open crib gate alarm system that keep's the user's child safe.

Even still another object of the present invention is to provide a new open crib gate alarm system that is easy and convenient to attach to any crib and hopefully prevents one's child from falling out of the crib.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
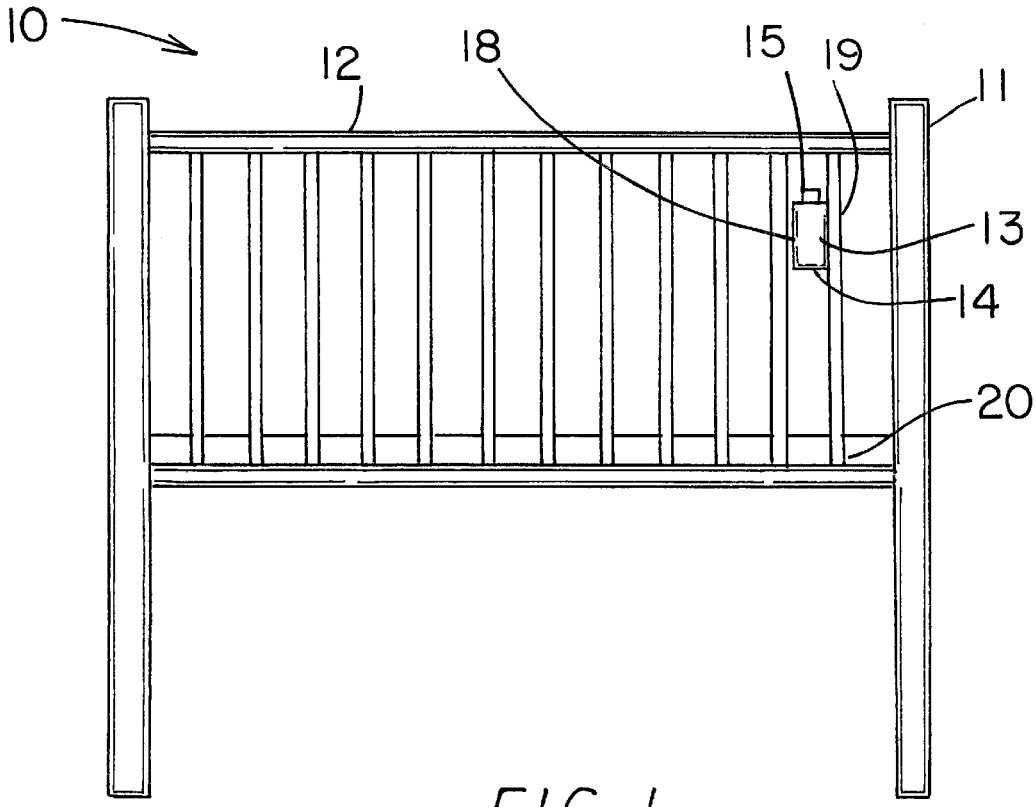
FIG. 1 is a side elevational view of a new open crib gate alarm system according to the present invention and shown in use.
Figure 2:
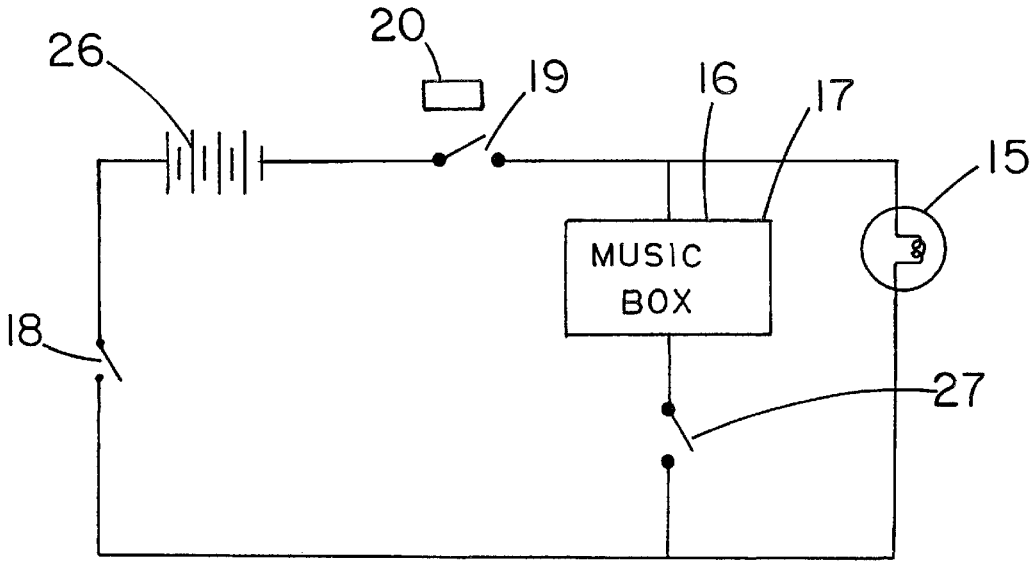
FIG. 2 is a schematic diagram of the alarm unit of the present invention.
Figure 3:
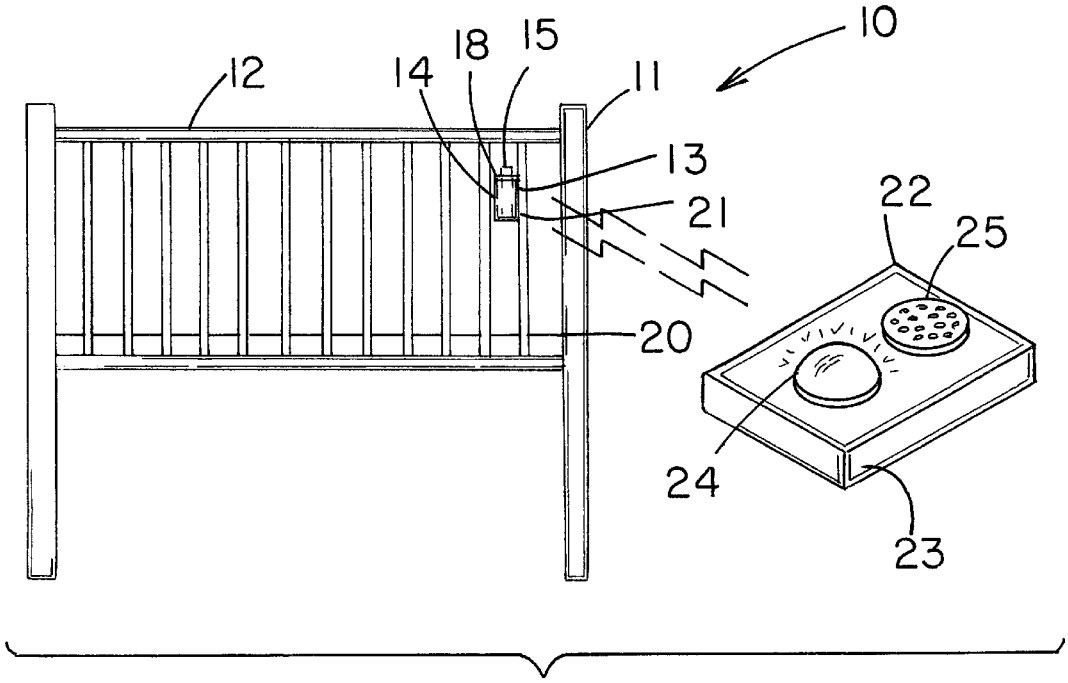
FIG. 3 is an exploded perspective view of a second embodiment of the present invention.

With reference now to the drawings, and in particular to FIGS. 1 through 3 thereof, a new open crib gate alarm system embodying the principles and concepts of the present invention and generally designated by the reference numeral 10 will be described.

As best illustrated in FIGS. 1 through 3, the open crib gate alarm system 10 generally comprises a crib 11 having a gate 12 which can be opened; and also comprises an alarm assembly including an alarm unit 13 having a housing 14 being securely and conventionally fastened to the gate 12, and also includes a first switch member 19 being securely and conventionally attached to the gate 12, and further includes a second switch member 20 being securely and conventionally attached to the crib 11 for activating the alarm unit 13 in combination with the first switch member 19. The alarm unit 13 further has a light-emitting member 15 being conventionally disposed in a wall of the housing 14 for producing visual alarm signals, and also has a sound-producing mechanism 16 being conventionally disposed in the housing 14 for producing audible alarm signals, and further has a speaker 17 being conventionally disposed in a wall of the housing 14 and being conventionally connected to the sound-producing mechanism 16, and also has a battery pack 26 being removably disposed in the housing 14 and being conventionally connected to the light-emitting member 15 and to the sound-producing mechanism 16, and further has a power switch 18 being conventionally attached to the housing 13 and being conventionally connected to the battery pack 26 and to the light-emitting member 15 and to the sound-producing mechanism 16. The first switch member 19 is conventionally connected to the sound-producing mechanism 16 and to the battery pack 26 and to the light-emitting member 15. The second switch member 20 is conventionally connected to the sound-producing mechanism 16 and to the battery pack 26 and to the light-emitting member 15. The first and second switch members 19,20 are in alignment with one another upon the gate 12 being in an open position thus closing a circuit with the alarm unit 13 and activating the visual and alarm signals. The first and second switch members 19,20 are not in alignment with one another upon the gate 12 being in a closed position thus opening the circuit with the alarm unit 13 and stopping the visual and alarm signals with the first and second switch members 19,20 being magnetic. For example, the first and second switch member may comprise elements of a magnetic reed contact switch where the magnet is coupled to the crib and the contact switch is connected to the alarm unit. The magnet causes the contacts within the switch to close thus completing the circuit and sounding the alarm when the gate is opened and the contacts are brought into close proximity to the magnet.

A muting switch 27 member is connected between the sound producing mechanism 16 and the battery pack 26. The muting switch 27 is for selectively opening the circuit of the sound producing mechanism 16 and thus preventing audible alarm signals from being produced when the circuit of the alarm unit 13 is closed.

As a second embodiment, the alarm assembly further includes a transmitter 21 being conventionally disposed in the housing 14, and also includes a portable receiver unit 22 being adapted to receive signals transmitted by the transmitter 21. The portable receiver unit 22 includes a housing member 23 being adapted to be carried and moved about, and also includes a light-emitting member 24 being conventionally disposed in a wall of the housing member 23 for emitting a visual alarm signal, and further includes a speaker 25 being conventionally disposed in a wall of the housing member 23 for emitting an audible alarm signal.

In use, if the gate 12 is left open or is not securely closed and is opened automatically, the first and second switch members 19,20 because of their locations will become aligned with one another and will close the circuit with the alarm unit 13 thus activating the light-emitting member 15 and the sound-producing mechanism 16 both of which will give off visual and audible alarm signals so that the user can go and close the gate 12 to the crib 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An open crib gate alarm system comprising:

a crib having a gate movable between an open position and a closed position; and an alarm assembly including an alarm unit movable with said gate and having a housing being securely fastened to said gate for causing movement of said housing with said gate, and also including a first switch member being securely attached to said gate for causing movement of said first switch member with said gate, and further including a second switch member being securely attached to said crib for activating said alarm unit in combination with said first switch member, said alarm unit further having a light-emitting member being disposed in a wall of said housing for producing visual alarm signals, and also having a sound-producing mechanism being disposed in said housing for producing audible alarm signals, and further having a speaker being disposed in a wall of said housing and being connected to said sound-producing mechanism, and also having a battery pack being removably disposed in said housing and being connected to said light-emitting member and to said sound-producing mechanism, and further having a power switch being attached to said housing and being connected to said battery pack and to said light-emitting member and to said sound-producing mechanism, said first switch member being connected to said sound-producing mechanism and to said battery pack and to said light-emitting member, and said second switch member being connected to said sound-producing mechanism and to said battery pack and to said light-emitting member, said first and second switch members being in alignment with one another upon said gate being in said open position thus closing a circuit with said alarm unit and activating the visual and alarm signals, said first and second switch members not being in alignment with one another upon said gate being in said closed position thus opening the circuit with said alarm unit and stopping the visual and alarm signals, said first and second switch members being magnetic.

2. An open crib gate alarm system comprising:

a crib having a gate movable between an open position and a closed position; and an alarm assembly including an alarm unit movable with said gate and having a housing being securely fastened to said gate for causing movement of said housing with said gate, and also including a first switch member being securely attached to said gate for causing movement of said first switch member with said gate, and further including a second switch member being securely attached to said crib for activating said alarm unit in combination with said first switch member, said alarm unit further having a light-emitting member being disposed in a wall of said housing for producing visual alarm signals, and also having a sound-producing mechanism being disposed in said housing for producing audible alarm signals, and further having a speaker being disposed in a wall of said housing and being connected to said sound-producing mechanism, and also having a battery pack being removably disposed in said housing and being connected to said light-emitting member and to said sound-producing mechanism, and further having a power switch being attached to said housing and being connected to said battery pack and to said light-emitting member and to said sound-producing mechanism, said first switch member being connected to said sound-producing mechanism and to said battery pack and to said light-emitting member, and said second switch member being connected to said sound-producing mechanism and to said battery pack and to said light-emitting member, said first and second switch members being in alignment with one another upon said gate being in said open position thus closing a circuit with said alarm unit and activating the visual and alarm signals, said first and second switch members not being in alignment with one another upon said gate being in said closed position thus opening the circuit with said alarm unit and stopping the visual and alarm signals, said first and second switch members being magnetic;

wherein said alarm assembly further includes a transmitter being disposed in said housing, and also includes a portable receiver unit being adapted to receive signals transmitted by said transmitter and being movable independent of said housing of said alarm assembly, said portable receiver unit including a housing member being adapted to carried and moved about, and also including a light-emitting member being disposed in a wall of said housing member for emitting a visual alarm signal, and further including a speaker being disposed in a wall of said housing member for emitting an audible alarm signal.

* * * * *